US005468713A

United States Patent [19]

Fujimura et al.

[11] Patent Number: 5,468,713

[45] Date of Patent: Nov. 21, 1995

[54] THERMAL TRANSFER RECORDING MEDIUM AND METHOD FOR THERMAL TRANSFER RECORDING

[75] Inventors: Hideo Fujimura; Yoshinori Nakamura, both of Tokyo, Japan

[73] Assignee: Dai Nippon Printing Co., Ltd., Japan

[21] Appl. No.: 91,384

[22] Filed: Jul. 15, 1993

Related U.S. Application Data

[62] Division of Ser. No. 800,329, Dec. 3, 1991, Pat. No. 5,254,523.

[30] Foreign Application Priority Data

| | | | |
|---|---|---|---|
| Dec. 5, 1990 | [JP] | Japan | 2-404643 |
| Dec. 5, 1990 | [JP] | Japan | 2-404644 |
| Dec. 5, 1990 | [JP] | Japan | 2-404645 |

[51] Int. Cl.[6] ..... B41M 5/035; B41M 5/38

[52] U.S. Cl. ..... 503/227; 428/195; 428/409; 428/913; 428/914

[58] Field of Search ..... 8/471; 428/195, 428/421, 422, 447, 913, 914, 409; 503/227

[56] References Cited

FOREIGN PATENT DOCUMENTS 2201291 9/1987 Japan ..... 503/227

*Primary Examiner*—B. Hamilton Hess

*Attorney, Agent, or Firm*—Parkhurst, Wendel & Rossi

[57] ABSTRACT

A method for thermal transfer recording including the steps of superposing a sublimation-type thermal transfer recording sheet on an image-receiving sheet including a dye-receiving layer, and applying thermal energy to the back surface of the thermal transfer recording sheet to produce an image in the dye-receiving sheet, in which an oil-repelling agent is supplied to the image-recorded surface when or after the image is produced so that the image-recorded surface can have a contact angle to tetradecane of 10° or greater; and a thermal transfer recording sheet and an image-receiving sheet for use in this recording method. An image which has excellent in resistance to stains such as resistance to fingerprints and resistance to plasticizers, durability and preservability can be obtained by the present invention.

1 Claim, 1 Drawing Sheet

THERMAL TRANSFER RECORDING MEDIUM AND METHOD FOR THERMAL TRANSFER RECORDING

This is a Division of application Ser. No. 07/800,329 filed Dec. 3, 1991, now U.S. Pat. No. 5,254,523.

BACKGROUND OF THE INVENTION

The present invention relates to a thermal transfer recording medium and a method for thermal transfer recording, and more particularly to a thermal transfer image-receiving sheet, a thermal transfer recording sheet and a method for thermal transfer recording which can produce an image having high resistance to oils.

Heretofore, various thermal transfer recording methods have been proposed. Of these, a sublimation-type thermal transfer recording method is now prevailing, in which a thermal transfer recording sheet comprising as a recording agent a sublimable dye which is retained by a substrate sheet such as paper or a plastic film, and an image-receiving sheet comprising a dye-receiving layer formed on paper or a plastic film are used in combination to produce various full-colored images in the dye-receiving layer.

In this recording method, a thermal head of a printer is employed as a heat application means, and a large number of dots in three or four colors are transferred to the image-receiving sheet in an extremely short heat application time. A full-colored original image can thus be successfully reproduced on the image-receiving sheet.

The image-receiving sheet for use in the above recording method is prepared by forming a thermoplastic resin layer which serves as a dye-receiving layer on the surface of a substrate sheet such as paper, synthetic paper or a plastic sheet. The dye-receiving layer therefore has a high affinity for oily or greasy substances such as sebum, a plasticizer and a solvent. For this reason, the dye-receiving layer in which an image has been produced is readily stained by a fingerprint when it is touched by a finger. Moreover, a dye which is forming the image is adversely affected by a soft vinyl chloride product such as a rubber eraser or a telephone cord when it is brought into contact with the dye-receiving layer. The image produced in the dye-receiving layer thus undergoes deterioration.

SUMMARY OF THE INVENTION

A first object of the present invention is to provide a thermal transfer image-receiving sheet capable of producing an image which is excellent in resistance to oils, specifically, resistance to fingerprints and resistance to plasticizers.

The first object can be attained by a thermal transfer image-receiving sheet comprising (i) a substrate sheet, and (ii) a dye-receiving layer comprising a dye-receiptive resin, formed on at least one surface of the substrate sheet, the dye-receiving layer having a contact angle between tetradecane and the dye-receiving layer of 10° or greater.

When a dye-receiving layer of a thermal transfer image-receiving sheet is so formed that it can have a contact angle to tetradecane of 10° or greater, an image produced therein is excellent in resistance to oils, specifically, resistance to fingerprint and resistance to plasticizer.

A second object of the present invention is to provide a thermal transfer recording sheet capable of producing an image which is excellent in resistance to oils, specifically, resistance to fingerprint and resistance to plasticizer.

The second object can be attained by the following four embodiments:

Namely, a first embodiment is a thermal transfer recording sheet comprising (i) a substrate film, and (ii) a dye layer comprising a dye, a binder and a oil-repelling agent, formed on the substrate film.

A second embodiment is a thermal transfer recording sheet comprising (i) a substrate film, (ii) a dye layer comprising a dye and a binder, formed on the substrate film, and (iii) an oil-repelling agent layer formed on the dye layer.

A third embodiment is a thermal transfer recording sheet comprising (i) a substrate film, (ii) a dye layer comprising a dye and a binder, formed on the substrate film, and (iii) an oil-repelling agent layer formed on the substrate film, adjacent to the dye layer.

A fourth embodiment is a thermal transfer recording sheet comprising (i) a substrate film, and (ii) an oil-repelling-agent-transferring layer formed on at least a part of the substrate film.

By supplying an oil-repelling agent from a thermal transfer recording sheet to the surface of a dye-receiving layer in which an image will be or has been produced, an image having high resistance to oils, specifically, resistance to fingerprints and resistance to plasticizers, can be obtained.

Moreover, when the image-recorded surface is made to have a contact angle to tetradecane of 10° or greater, the image is improved in resistance to oils, specifically, resistance to fingerprints and resistance to plasticizers.

A third object of the present invention is to provide a thermal-transfer-recorded image which has excellent resistance to oils, specifically, resistance to fingerprints and resistance to plasticizers, and to provide a method for producing the same.

The third object can be attained by the following invention:

Namely, the third invention provides a method for thermal transfer recording comprising the steps of (i) superposing a sublimation-type thermal transfer recording sheet on an image-receiving sheet comprising a dye-receiving layer, and (ii) applying thermal energy to the back surface of the thermal transfer recording sheet by a heat application means to produce an image in the dye-receiving layer, in which an oil-repelling agent is supplied to the image-recorded surface when or after the image is produced so that the image-recorded surface can have a contact angle to tetradecane of 10° or greater; and a thermal-transfer recorded image produced on a thermal transfer image-receiving sheet by means of a sublimation-type thermal transfer recording method, wherein the image-recorded surface of the thermal transfer image-receiving sheet has a contact angle to tetradecane of 10° or greater.

When the contact angle between tetradecane and the surface of a dye-receiving layer in which an image is produced is 10° or greater, the image is excellent in resistance to oils, specifically, resistance to fingerprints and resistance to plasticizers.

In the case where fingers or a material containing a plasticizer such as a rubber eraser is brought into contact with an image-recorded surface of an image-receiving sheet, the image-recorded surface is stained with a fingerprint, or sebum or the plasticizer deposited on the image-recorded surface reacts with a dye contained in the image-receiving sheet to give a stain. As a result, the quality of the image drastically deteriorates. The phrases "resistance to fingerprints" and "resistance to plasticizers" used herein are referred to as the properties with which an image produced on an image-receiving sheet can resist the above staining and can maintain its quality.

In particular, resistance to fingerprints can be remarkably improved when an image-recorded surface is made repellent to sweat or sebum deposited by a finger. A method for measuring the contact angle between water and an image-recorded surface of a thermosensitive recording material is described in Japanese Laid-Open Patent Publications Nos. 128987/1988 and 169291/1990. However, only water repellence can be evaluated by this method, and oil repellence which is greatly related to resistance to fingerprints cannot be evaluated.

We evaluated resistance to oils, specifically, resistance to fingerprint and resistance to plasticizer, using tetradecane. As a result, it was found that when the contact angle between tetradecane and an image-recorded surface is 10° or greater, the image is excellent in resistance to oils.

The reasons why we employed tetradecane for the evaluation of the resistance to oils are as follows:

There is no conventional method suitable for determining the relationship between sebum such as of a fingerprint and oil repellence of an image-recorded surface; and tetradecane is stable under the conditions for measuring the contact angle; in other words, under such conditions, it has a low vaporizing speed, does not react with a resin contained in a dye-receiving layer, does not dissolve the resin, and is safe because its boiling point and melting point do not lie in the vicinity of room temperature (20° C.).

BRIEF DESCRIPTION OF THE DRAWINGS

A more complete appreciation of the invention and many of the attendant advantages thereof will be readily obtained as the same becomes better understood with reference to the following detailed description when considered in connection with the accompanying drawings, wherein.

DESCRIPTION OF THE PREFERRED EMBODIMENT

Figure 1:
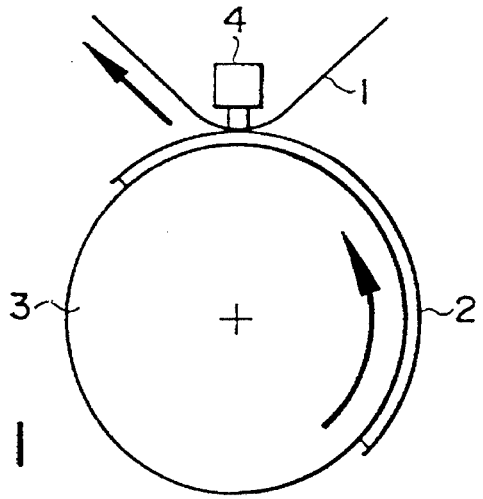
FIG. 1 and FIG. 2 are sectional views explaining the method for thermal transfer recording according to the present invention.

The present invention will now be explained in detail referring to the preferred embodiments.

Thermal Transfer Image-Receiving Sheet

The thermal transfer image-receiving sheet according to the present invention comprises a substrate sheet, and a dye-receiving layer formed on at least one surface of the substrate sheet.

Examples of the substrate sheet for use in the present invention include synthetic paper (polyolefin type, polystyrene type, etc.), high quality paper, art paper, coated paper, cast-coated paper, wall paper, backing paper, paper impregnated with a synthetic resin or an emulsion, paper impregnated with a synthetic rubber latex, paper containing a synthetic resin, cardboard, cellulose fiber paper, plastic films or sheets such as of polyolefin, polyvinyl chloride, polyethylene terephthalate, polystyrene, polymethacrylate and polycarbonate. In addition, a white opaque film prepared using a mixture of the above resin and a white pigment or a filler, or an expanded sheet prepared by expanding the mixture can also be used as the substrate sheet. Thus, no particular limitation is imposed on the material of the substrate sheet.

Furthermore, a laminate prepared using any of the above-described sheets and films in combination is also employable as the substrate sheet. Typical examples of the laminate are a laminate of cellulose fiber paper and synthetic paper, and a laminate of cellulose fiber paper and a plastic film or sheet.

There is no limitation on the thickness of the substrate sheet. However, the thickness is, in general, approximately from 10 to 300 μm.

In the case where the adhesion between the substrate sheet and the dye-receiving layer provided thereon is not sufficiently high, it is preferable to treat the surface of the substrate sheet with a primer or corona discharge.

The dye-receiving layer provided on the substrate sheet receives a sublimable dye which is transferred from a thermal transfer recording sheet, and retains an image produced therein. In the present invention, the dye-receiving layer is so formed that it can have a contact angle to tetradecane of 10° or greater.

Examples of resin employable for forming the dye-receiving layer include polyolefin resins such as polypropylene, halogenated polymers such as polyvinyl chloride and polyvinylidene chloride, vinyl polymers such as polyvinyl acetate and polyacrylate, polyester resins such as polyethylene terephthalate and polybutylene terephthalate, polystyrene resins, polyamide resins, copolymeric resins of an olefin such as ethylene or propylene and a vinyl monomer, ionomers, cellulose resins such as cellulose diacetate, and polycarbonate. Of these resins, vinyl resins and polyester resins are particularly preferred.

The thermal transfer image-receiving sheet of the present invention can be prepared in the following manner:

The above resin and additives such as a releasing agent are dissolved in a proper organic solvent, or dispersed in a proper organic solvent or water. The solution or dispersion is coated onto at least one surface of the above-described substrate sheet by, instance, a gravure printing method, a screen printing method or a reverse roller coating method using a gravure, dried, and heated to form a dye-receiving layer and a releasing layer on the substrate sheet.

It is also possible to incorporate a pigment or a filler such as titanium oxide, zinc oxide, kaolin clay, calcium carbonate or fine powder of silica into the dye-receiving layer in order to increase the whiteness thereof. The sharpness of an image produced in the dye-receiving layer can thus be enhanced.

A dye-receiving layer having an angle of contact with tetradecane of 10° or grater can be formed by, for instance, one of the following methods:

a method in which a dye-receiving layer is formed using, instead of the previously-mentioned resin, a resin which is highly repellent to oils, such as a fluorine-modified resin or a hydrophilic resin, or using such a resin together with the previously-mentioned resin;

a method in which an oil-repelling agent such as a fluorine-containing surface active agent, a fluororesin, a fluorooligomer, a fluorine-modified silicone oil or a fluorosilane coupling agent is incorporated into a dye-receiving layer, or applied onto a dye-receiving layer to form a thin oil-repelling agent layer; and a method in which a filler having high oil-absorbing ability such as microsilica is incorporated into a dye-receiving layer so that the layer can absorb and fix a plasticizer or the like deposited on the dye-receiving layer.

The fluorine-modified resin can be obtained by copolymerizing a vinyl monomer, an acrylate monomer or a methacrylate monomer which has a fluorine-containing substituent in its side chain and a vinyl monomer, an acrylate monomer or a methacrylate monomer which does not contain fluorine. A dialcohol or a dicarboxylic acid which can serve as a macromonomer or a radical initiator can be used in the above polymerization reaction. Moreover, a graft copolymer or a black copolymer which can be obtained by anion polymerization or the like is employable in the present invention.

Specific examples of the fluorine-containing monomers and oligomers are as follows:

(meth)acrylates containing a perfluoroalkyl group such as $C_7F_{15}CH_2OCOCH{=}CH_2$, $C_7F_{15}CH_2OCOC(Me){=}CH_2$, $CF_3(CF_2)_2CH_2OCOC(Me){=}CH_2$, $CF_3(CF_2)_4(CH_2)_2OCOC(Me){=}CH_2$, $CF_3(CF_2)_3(CH_2)_2OCOC(Me){=}CH_2$, $(CF_3)_2CF(CF_2)_8(CH_2)_2OCOCH{=}CH_2$, $(CF_3)_2CF(CF_2)_8(CH_2)_2OCOC(Me){=}CH_2$, $C_8F_{17}CH_2CH(OH)CH_2OCOC(Me){=}CH_2$, $C_8F_{17}(CF_2)_{11}OCOC(Me){=}CH_2$, $C_7F_{15}CON(Et)(CH_2)_2OCOC(Me){=}CH_2$, $C_6F_{13}SO_2N(Me)(CH_2)_2OCOCH{=}CH_2$, $C_8F_{17}SO_2N(Pr)(CH_2)_2OCOCH{=}CH_2$, $C_8F_{17}SO_2N(Me)(CH_2)_2OCOC(Me){=}CH_2$, $C_8F_{17}SO_2N(Me)(CH_2)_{18}OCOCH_2CH{=}CH_2$, $C_8F_{17}SO_2N(CH_2CH_2OCOCH{=}CH_2)$, $HCF_2(CF_2)_7CH_2OCOC(Me){=}CH_2$, vinyl ethers and allyl ethers containing the same perfluoroalkyl group as the above, such as $C_7F_{15}CH_2OCH{=}CH_2$ and $C_7F_{15}CH_2OCH_2CH{=}CH_2$, and vinylsulfones containing the same perfluoroalkyl group as the above, such as $C_8F_{17}SO_2NHCH_2SO_2CH{=}CH_2$.

In the above formulae, "Me" denotes a methyl group, "Et" denotes an ethyl group, and "Pr" denotes a propyl group.

Examples of the monomer which does not contain fluorine include styrene and its derivatives, acrylic acid, methacrylic acid, alkyl esters of acrylic acid, alkyl esters of methacrylic acid and amides. In the case where 2-hydroxyethylacrylate or methacrylate is employed as the monomer, the resulting polymer can be hardened by polyisocyanate because an —OH group is contained in the polymer.

In order to arrange fluorine atoms on the surface of the fluorine-modified resin, it is effective to introduce a dimethylsiloxane chain into the fluorine-modified resin. Specifically, a silicone-modified fluororesin is obtainable by copolymerizing polydimethylsiloxane having an acryloyl group or a methacryloyl group as an end group; by reacting a dialcohol which can serve as a radical initiator with polydimethylsiloxane having alcohol groups at its both ends in the presence of isocyanate to give a polymer having an urethane moiety; or by reacting a dicarboxylic acid which can serve as a radical initiator with polydimethlsiloxane having epoxy groups at its both ends.

A fluorosilicone-modified resin is obtainable by a polymerization reaction between polydimethyl siloxane having alcohol groups at its both ends and fluoroalcohol in the presence of polyisocyanate. Specific examples of the fluoroalcohol are as follows:

$C_8F_{17}C_2H_4OH$, $C_6F_{13}C_2H_4OH$, $(CF_3)_2CFC_{10}F_{20}C_2H_4OH$, $C_8F_{17}C_2H_4OH$, $C_{10}F_{21}C_2H_4OH$, $C_8F_{17}SO_2N(C_2H_5)C_2H_4OH$, $C_8F_{17}SO_2N(Me)C_2H_4OH$, $(CF_3)_2CHOH$

A fluorosilicone-modified resin is also obtainable by reacting methylhydrogen polysiloxane with a fluoroalkylallyl ether, a fluoroalkylvinyl ether, fluoroacrylate or fluoromethacrylate in the presence of a platinum catalyst.

Further, a fluorosilicone-modified resin can also be prepared by a reaction between diethylpolysiloxane having a silanol group and a fluoroalkylsilane.

Specific examples of the fluoroalkylsilane are .as follows:

$CF_3CH_2CH_2Si(OMe)_3$, $CF_3CH_2CH_2SiCl_3$, $CF_3(CF_2)_5CH_2CH_2SiCl_3$, $CF_3(CF_2)_5CH_2CH_2Si(OMe)_3$, $CF_3(CF_2)_7CH_2CH_2SiCl_3$, $CF_3(CF_2)_7CH_2CH_2Si(OMe)_3$, $CF_3(CF_2)_7CH_2CH_2SiMeCl_2$, $CF_3(CF_2)_7CH_2CH_2SiMe(OMe)_2$

In this case, the dye-receiving layer can be obtained even in the following manner:

A composition containing dimethylpolysiloxane having a silanol group is coated onto the substrate film and dried to form a layer. A methanol solution of a fluoroalkylsilane is then coated onto this layer, dried, and finally heated to form a dye-receiving layer.

There is no limitation on the thickness of the dye-receiving layer, and, in general, it is in the range of 1 μm to 50 μm. It is preferable that the dye-receiving layer be a continuous layer. However, a non-continuous layer formed using an emulsion or dispersion of the resin is also employable.

By properly selecting a material for the substrate sheet, the thermal transfer image-receiving sheet of the present invention is utilizable for a variety of purposes such as cards and transparent sheets in which an image can be produced by thermal transfer recording.

A cushion layer may be interposed between the substrate sheet and the dye-receiving layer, if necessary. The cushion layer can absorb noises which are made when printing is conducted. Therefore, when such a layer is provided, an original image can be reproduced in the dye-receiving layer with high fidelity.

Examples of the material for forming the cushion layer include polyurethane resins, acrylic resins, polyethylene resins, butadiene rubber and epoxy resins. Of these, an expandable polyethylene and an expandable polypropylene are particularly preferred. It is preferable that the thickness of the cushion layer be in the range of approximately 2 to 20 μm.

Furthermore, a lubricating layer may be provided on the back surface of the substrate sheet. Examples of the material for preparing the lubricating layer include methacrylate resins or corresponding acrylate resins such as methylmethacrylate, and vinyl resins such as a copolymer of vinyl chloride and vinyl acetate.

It is also possible to provide a detective mark on the image-receiving sheet. A detective mark is very convenient to properly position a thermal transfer recording sheet and an image-receiving sheet. For instance, it can be provided by forming a mark which is detectable by a phototube detector on the back surface of the substrate sheet by means of printing or the like.

A thermal transfer recording sheet which is employed for thermal transfer recording in combination with the thermal transfer image-receiving sheet of the present invention is a recording sheet prepared by providing a dye layer containing a sublimable dye on paper or a polyester film. Any conventionally known thermal transfer recording sheet can be used as it is in the present invention.

To conduct thermal transfer recording, any conventional means for applying thermal energy such as a thermal pen, a thermal plate, a thermal head or a laser can be employed. For example, a desired image can be successfully obtained by applying approximately 5 to 100 mj/mm$^2$ of thermal energy, which is changeable by controlling the printing time, to the thermal transfer recording sheet by a thermal printer such as a "Video Printer VY-100" (Trademark) manufactured by Hitachi Co,. Ltd.

Thermal Transfer Recording Sheet

The thermal transfer recording sheet according to the present invention will now be explained in detail referring to the preferred embodiments.

The thermal transfer recording sheet of the present invention is prepared by providing a dye layer comprising a sublimable dye and a binder resin on a proper substrate film such as a polyester film.

Any known material can be used for forming the substrate film for use in the present invention as long as it has proper heat resistance and strength. For instance, paper, processed paper of various kinds, a polyester film, a polystyrene film, a polypropylene film, a polysulfone film, an aramide film, a polycarbonate film, a polyvinyl alcohol film or cellophane can be used as the substrate film. Of these, a polyester film is particularly preferred. The thickness of the substrate film is approximately from 0.5 to 50 μm, preferably from 3 to 10 μm.

In the case where the adhesion between the substrate film and the dye layer provided thereon is not sufficiently high, it is preferable to treat the surface of the substrate film with a primer or corona discharge.

The dye layer to be formed on the above substrate film is a sublimable (heat-transferable) dye layer comprising at least one dye selected from the below-described dyes and a proper binder resin.

No particular limitation is imposed on the dye for use in the present invention, and any dye which has been used in conventional thermal transfer recording sheets can be employed. Some preferable examples of the dye include MS Red G, Macrolex Red Violet R, Ceres Red 7B, Samaron Red HBSL and Resolin Red $F_3BS$ as magenta dyes; Foron Brilliant Yellow 6GL, PTY-52 and Macrolex Yellow 6G as yellow dyes; and Kayaset Blue 714, Waxolin Blue AP-FW, Foron Brilliant Blue S-R and MS Blue 100 as cyan dyes.

Any known resin employable as a binder can be used as the binder resin which supports the above heat-transferable dye. Preferable examples of the binder resin include cellulose resins such as ethyl cellulose, hydroxyethyl cellulose, etylhydroxy cellulose, hydroxypropyl cellulose, methyl cellulose, cellulose acetate and cellulose butyrate, vinyl resins such as polyvinyl alcohol, polyvinyl acetate, polyvinyl butyral, polyvinyl acetal, polyvinyl pyrrolidone and polyvinyl acrylamide, and polyester resins. Of these, cellulose resins, polyvinyl acetal, polyvinyl butyral, and polyester resins are particularly preferred.

The dye layer of the thermal transfer recording sheet of the, present invention is basically prepared using the above-described materials. However, various known additives may be incorporated into the dye layer, if necessary.

The dye layer is prepared in the following manner:

The above-described sublimable dye, binder resin and additives are dissolved or dispersed in a proper solvent to give a coating composition or an ink for forming a dye layer. The coating composition or the ink is coated onto the above substrate film, and then dried to form a dye layer.

The thickness of the dye layer is approximately from 0.2 to 5.0 μm, preferably from 0.4 to 2.0 μm. The amount of the sublimable dye contained in the dye layer is from 5% to 90% by weight, preferably from 10% to 70% by weight, of the total weight of the dye layer.

The thermal transfer recording sheet according to the first embodiment of the present invention is characterized in that the dye layer comprises an oil-repelling agent.

Examples of the oil-repelling agent include fluorine-modified resins, hydrophilic resins, fluorine-containing surface active agents, fluororesins, fluorooligomers and fluorine-modified silicone oils. It is preferable that the oil-repelling agent be a substance which is transferable to the surface of an image-receiving sheet at a recording temperature. The amount of the oil-repelling agent is preferably from 1% to 30% by weight of 100 parts by weight of the binder resin used in the dye layer. Further, when a dye layer is composed of, for instance, three color layers of yellow, magenta and cyan, it is preferable to incorporate the oil-repelling agent into at least a color layer which is lastly transfer red to an image-receiving sheet; for example, in the case where images of yellow, magenta and cyan are produced in this order, the oil-repelling agent is preferably incorporated into at least a cyan color layer.

The thermal transfer recording sheet according to the second embodiment of the present invention is characterized in that a layer of the above oil-repelling agent is provided on the surface of the dye layer. The oil-repelling agent layer is, in general, formed using an oil-repelling agent which has high thermal transferability and the above-described binder resin. The amount of the oil-repelling agent is from 1% to 30% by weight of 100 parts by weight of the binder resin used in the oil-repelling agent layer. It is preferable that the thickness of the oil-repelling agent layer be approximately from 0.5 to 5 g/m$^2$ when expressed by a coating amount. Further, when a dye layer is composed of, for instance, three color layers of yellow, magenta and cyan, it is preferable to form the oil-repelling agent layer on at least a color layer which is lastly transferred to an image-receiving sheet; for example, in the case where images of yellow, magenta and cyan are produced in this order, the oil-repelling agent layer is preferably formed on at least a cyan color layer.

Figure 3:
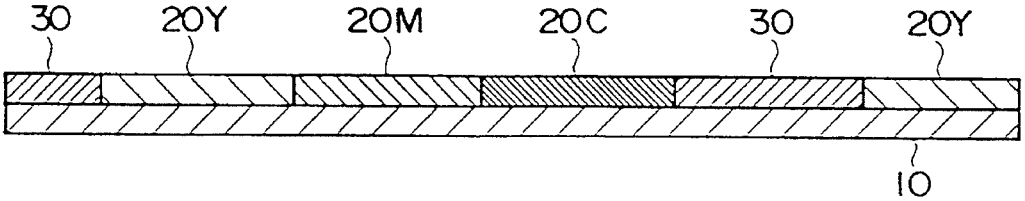
FIG. 3 is a sectional view showing one embodiment of the thermal transfer recording sheet according to the present invention.

The thermal transfer recording sheet according to the third embodiment of the present invention is characterized in that an oil-repelling agent layer 30 is formed adjacent to a dye layer 20 as shown in FIG. 3. This thermal transfer recording sheet is prepared by forming a dye layer 20 on a substrate film 10 in the conventional manner, and an oil-repelling agent layer 30 on the substrate film 10, adjacent to the dye layer. Illustrated in FIG. 3 is a thermal transfer recording sheet prepared in such a manner that a yellow color layer 20Y, a magenta color layer 20M and a cyan color layer 20C are respectively provided on the substrate film 10 in this order, and an oil-repelling agent layer 30 is finally provided on the substrate film, adjacent to the cyan color layer. It is also possible to provide the oil-repelling agent layers both before and after each color layer. However, it is preferable to provide the oil-repelling agent layer after a color layer which is lastly transferred to an image-receiving sheet. The oil-repelling agent layer is, in general, formed using an oil-repelling agent which has high thermal transferability and the above-described binder resin. The amount of the oil-repelling agent from 1% to 30% by weight of 100 parts by weight of the binder resin used in the oil-repelling agent layer. It is preferable that the thickness of the oil-repelling agent layer be approximately from 0.5 to 5 $g/m^2$ when expressed by a coating amount.

Figure 2:
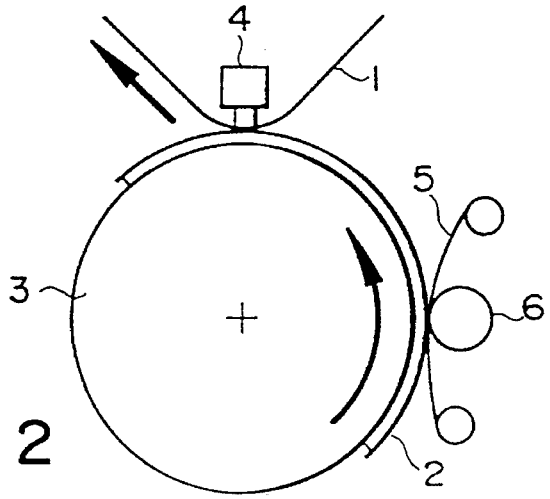

The thermal transfer recording sheet according to the fourth embodiment of the present invention is prepared by providing the same oil-repelling agent layer as is provided in the recording sheet of the third embodiment on the entire surface of a substrate film. For example, as shown in FIG. 2, a thermal transfer recording sheet 1 is firstly superposed in an image-receiving sheet 2 on a platen 3, and heat is applied by a thermal head 4 to the back surface of the thermal transfer recording sheet to transfer a dye to the image-receiving sheet. Therefore, an oil-repelling-agent-transferring sheet 5 is superposed on the image-recorded surface of the image-receiving sheet, and the oil-repelling agent is transferred to the image-recorded surface by a heat roller 6. It is also possible to transfer the oil-repelling agent to the image-receiving sheet before an image is produce therein.

When the image-recorded surface which is supplied with the oil-repelling agent in the above manner has a contact angle to tetradecane of 10° or greater, the image has excellent resistance to oils, specifically, resistance to fingerprints and resistance to plasticizers.

A heat-resistant layer may be provided on the back surface of the substrate sheet of the thermal transfer recording sheet of the present invention in order to protect the recording sheet from unfavorable effects caused by heat generated by a thermal head.

Any thermal transfer image-receiving sheet which is receptive to the sublimable dye contained in the dye layer can be used together with the thermal transfer recording sheet of the present invention. Even those materials which are not receptive to the dye, such as paper, metals, glass and synthetic resins are employable as thermal transfer image-receiving sheets if they are provided with a dye-receiving layer on at least one surface of sheets or films of the above materials.

To conduct thermal transfer recording, any conventional means for applying thermal energy such as a thermal pen, a thermal plate, a thermal head or a laser is employable. For instance, a desired image can be successfully obtained by applying approximately 5 to 100 $mJ/m^2$ of thermal energy, which is changeable by controlling the printing time, to the thermal transfer recording sheet by a thermal printer such as a "Video Printer VY-100" (Trademark) manufactured by Hitachi Co., Ltd.

Method for Thermal Transfer Recording

The method for thermal transfer recording according to the present invention will now be explained in detail referring to the preferred embodiments.

A thermal transfer recording sheet prepared by providing a dye layer comprising a sublimable dye and a binder resin on a proper substrate film such as a polyester film is employed in the method for thermal transfer recording of the present invention. Such a thermal transfer recording sheet is already known in the field of thermal transfer recording.

A thermal transfer image-receiving sheet for use in the method of the present invention is prepared by providing a sublimable-dye-receptive resin film or a dye-receiving layer comprising the resin on a proper substrate sheet such as paper. Such an image-receiving sheet is also known in the field of thermal transfer recording.

Moreover, a thermal transfer recording method using the above thermal transfer recording sheet and thermal transfer image-receiving sheet is already well known.

However, the method for thermal transfer recording according to the present invention comprising the steps of superposing a thermal transfer recording sheet 1 on a thermal transfer image-receiving sheet 2 on a platen 3, and applying thermal energy imagewise to the back surface of the thermal transfer recording sheet by a thermal head 4 to produce an image in a dye-receiving layer of the image-receiving sheet is characterized in that an oil-repelling agent is supplied to the image-recorded surface when or after the thermal transfer recording is conducted so that the image-recorded surface can have a contact angle to tetradecane of 10° or greater.

Examples of the above oil-repelling agent include fluorine-modified resins, hydrophilic resins, fluorine-containing surface active agents, fluororesins, fluorooligomers and fluorine-modified silicone oils.

There is no particular limitation on the method for supplying the oil-repelling agent to an image-recorded surface. However, the following methods are preferred.

(1) A method in which an oil-repelling agent incorporated into at least one color layer out of three color layers of yellow, cyan and magenta, or applied to the surface of a dye layer in advance, and is supplied to an image-recorded surface at the time of the formation of an image as shown in FIG. 1.

(2) A method in which an oil-repelling agent is transferred to an image-recorded surface using an oil-repelling-agent-transferring sheet 5 as shown in FIG. 3.

The oil-repelling-agent-transferring sheet is prepared by providing an oil-repelling agent layer on the enter surface of a substrate film.

(3) A method using a thermal transfer recording sheet in which an oil-repelling agent layer 30 is provided on a substrate film 10, adjacent to a dye layer 20 as shown in FIG. 3.

A thermal transfer recording sheet for use in this method is prepared by forming a dye layer 20 on a substrate film 10 in a conventional manner, and an oil-repelling agent layer 30 on the substrate film, adjacent to the dye layer 20. Illustrated in FIG. 3 is a thermal transfer recording sheet prepared by forming a yellow color layer 20Y, a magenta color layer 20M and a cyan color layer 20C in this order, and an oil-repelling agent layer 30 on the substrate film, adjacent to the cyan color layer. However, the dye layer is not necessarily composed of three color layers. A dye layer composed of one, two or even four color layers including a black color layer is also employable.

The above-described methods are preferred ones, and the following methods are also adoptable in the present invention:

a method in which a thin solution of an oil-repelling agent in a volatile solvent such as an alcohol is coated onto an image-recorded surface by means of coating or spraying;

a method in which a fluorine compound is supplied to an image-recorded surface by deposition; and a method in which an image-recorded surface is subjected to a plasma treatment along with a fluorine compound.

In the present invention, the amount of the oil-repelling agent coated onto an image-recorded surface is, in general, approximately from 0.01 to 1 g/m$^2$.

To conduct thermal transfer recording, any conventional means for applying thermal energy such as a thermal pen, a thermal plate, a thermal head or a laser is employable. For instance, a desired image can be successfully obtained by applying approximately 5 to 100 mJ/mm$^2$ of thermal energy, which is changeable by controlling the printing time, to the thermal transfer recording sheet by a thermal printer such as a "Video Printer VY-100" (Trademark) manufactured by Hitachi Co., Ltd.

This invention will now be explained more specifically with reference to the following Examples and Comparative Examples. However, the following examples should not be construed as limiting the present invention. Throughout the examples, quantities expressed in "parts" and "percent (%)" are on the weight basis, unless otherwise indicated.

EXAMPLES A1 TO A7 AND COMPARATIVE EXAMPLES A1 TO A6

A coating solution having the formulation shown in Table A1 was coated onto one surface of a substrate sheet, synthetic paper "Yupo FRG-150" (Trademark) with a thickness of 150 μm manufactured by Oji-Yuka Synthetic Paper Co., Ltd., by a bar coater in an amount of 10.0 g/m$^2$ on dry basis, and roughly dried by a dryer. This was then dried in an oven at a temperature of 100° C. for 30 minutes to form a dye-receiving layer. Thermal transfer image-receiving sheets according to the present invention and comparative ones were thus prepared.

| | |
|---|---|
| Resin shown in Table A1 | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Solvent shown in Table A1 | 400 parts |

TABLE A1

| | Resin | Solvent (weight ratio) |
|---|---|---|
| Example A1 | Polyvinyl alcohol | Water |
| Example A2 | Polycarbonate | Methylene chloride |
| Example A3 | Polystyrene | Toluene |
| Example A4 | Vinyl chloride-acryl-tetrafluoromethacrylate copolymer | Toluene/MEK (1/1) |
| Example A5 | Vinyl chloride-acryl-triflboroethyl-methacrylate copolymer | Toluene/MEK (1/1) |
| Example A6 | Sodium salt of a 1% sulfonated compound of vinyl chlorideacryl copolymer | Toluene/MEK (1/1) |
| Example A7 | Sodium salt of a 1% phosphatized compound of vinyl chlorideacryl copolymer | Toluene/MEK (1/1) |
| Comparative Example A1 | Polyester | Toluene |
| Comparative Example A2 | Polyamide | Toluene/IPA (1/1) |
| Comparative Example A3 | Vinyl chloride-vinyl acetate copolymer | Toluene |
| Comparative Example A4 | Cellulose triacetate | Methylene chloride/ethyl alcohol (9/1) |
| Comparative Example A5 | Polyurethane emulsion | Water |
| Comparative Example A6 | Vinyl chloride-acryl copolymer | Toluene/MEK (1/1) |

EXAMPLE A8

The procedure of Example A1 was repeated except that the coating solution employed in Example A1 was replaced by a coating solution having the following formulation, whereby a thermal transfer image-receiving sheet according to the present invention was obtained.

| | |
|---|---|
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Fluorine-containing surface active agent ("Fluorald FC-430" (Trademark) manufactured by Sumitomo 3M Limited) | 0.5 parts |
| Toluene | 400 parts |

EXAMPLE A9

The procedure of Example A1 was repeated except that a dye-receiving layer was formed using Coating Solution A having the following formulation. Coating Solution B having the following formulation was then coated onto the dye-receiving layer in an amount of 0.5 g/m$^2$ on dry basis, and dried, whereby a thermal transfer image-receiving sheet according to the present invention was obtained.

| Formulation of Coating Solution A: | |
|---|---|
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Toluene | 400 parts |
| Formulation of Coating Solution B: | |

-continued

| | |
|---|---|
| Fluorine-containing surface active agent ("Fluorald FC-43011 (Trademark) manufactured by Sumitomo 3M Limited) | 0.5 parts |
| Toluene | 400 parts |

COMPARATIVE EXAMPLE A7

The procedure of Example A1 was repeated except that the coating solution used in Example A1 was replaced by a coating solution having the following formulation, whereby a comparative thermal transfer image-receiving sheet was obtained.

| Formulation of Coating Solution: | |
|---|---|
| Copolymer of vinyl chloride and vinyl acetate ("#1000A" (Trademark) manufactured by Denki Kagaku Kogyo Kabushiki Kaisha) | 50 parts |
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Toluene | 400 parts |

EXAMPLE A10

The procedure of Example A1 was repeated except that the coating solution used in Example A1 was replaced by a coating solution having the following formulation, whereby a thermal transfer image-receiving sheet according to the present invention was obtained.

| Formulation of Coating Solution: | |
|---|---|
| Copolymer of vinyl chloride and vinyl acetate ("#1000A" (Trademark) manufactured by Denki Kagaku Kogyo Kabushiki Kaisha) | 50 parts |
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Fluororesin ("Sarflon S-382" (Trademark) manufactured by Asahi Glass Co., Ltd.) | 0.5 parts |
| Toluene | 400 parts |

EXAMPLE A11

The procedure of Example A1 was repeated except that the coating solution used in Example A1 was replaced by a coating solution having the following formulation, whereby a thermal transfer image-receiving sheet according to the present invention was obtained.

| Formulation of Coating Solution: | |
|---|---|
| Copolymer of vinyl chloride and vinyl acetate ("#1000A" (Trademark) manufactured by Denki Kagaku Kogyo Kabushiki Kaisha) | 50 parts |
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Fluororesin ("Sarflon S-382" (Trademark) manufactured by Asahi Glass Co., Ltd.) | 0.5 parts |
| Toluene | 400 parts |

COMPARATIVE EXAMPLE A8

The procedure of Example A1 was repeated except that the coating solution used in Example A1 was replaced by a coating solution having the following formulation, whereby a comparative thermal transfer image-receiving sheet was obtained.

| Formulation of Coating Solution: | |
|---|---|
| Copolymer of vinyl chloride and vinyl acetate ("#1000A" (Trademark) manufactured by Denki Kagaku Kogyo Kabushiki Kaisha) | 50 parts |
| Polyester ("Vylon 600" (Trademark) manufactured by Toyobo Co., Ltd.) | 50 parts |
| Amino-modified silicone ("KF-393" (Trademark) manufactured by Shin-Etsu Chemical Co., Ltd.) | 10 parts |
| Epoxy-modified silicone ("X-22-343" (Trademark) manufactured by Shin-Etsu Chemical Co., Ltd.) | 10 parts |
| Toluene | 400 parts |

On the other hand, a thermal transfer recording sheet was prepared in the following manner:

A coating solution for forming a dye layer having the following formulation was prepared. The coating solution was applied by a wire bar to a polyethylene terephthalate film having a thickness of 4.5 μm with its back surface imparted with heat resistance, and dried. The amount of the coating solution applied was 1.0 g/m$^2$ on dry basis. Several drops of silicon oil, "X-41.4003A" (Trademark) manufactured by Shin-Etsu Chemical Co., Ltd., were deposited on the back surface of the polyethylene terephthalate film using a dropping pipette, and then spread over the entire surface thereof. A back-coated thermal transfer recording sheet was thus obtained.

| Formulation of Coating Solution: | |
|---|---|
| Disperse dye, C.I. Solvent Blue 63 ("Kayaset Blue 714" (Trademark) manufactured by Nippon Kayaku Co., Ltd.) | 7 pars |
| Polyvinyl butyral resin ("S-Lec BX-1" (Trademark) manufactured by | 4.5 parts |

-continued

| Formulation of Coating Solution: | |
|---|---|
| by Sekisui Chemical Co., Ltd.) | |
| Methyl ethyl ketone/toluene (weight ratio = 1:1) | 90 parts |

The thermal transfer image-receiving sheets prepared in Examples A1 to A11 and Comparative Examples A1 to A8 were evaluated in accordance with the following manner:

Each thermal transfer image-receiving sheet was superposed on the above-prepared thermal transfer recording sheet so that the dye-receiving layer of the image-receiving sheet faced the dye layer of the recording sheet. Thermal energy was then applied to the back surface of the heat transfer recording sheet by a thermal head to produce a cyan image under the following conditions:

| | |
|---|---|
| Output power: | 1 W/dot |
| Pulse width: | 0.3 to 0.45 msec |
| Dot density: | 6 dots/mm |

The image-recorded surface was evaluated in terms of the angles of contact and resistance to oils, specifically, resistance to fingerprints and resistance to plasticizers. The results are shown in Table A2.

TABLE A2

| | Contact Angle | | Resistance to Oils | |
|---|---|---|---|---|
| | to Tetradecane | to Water | Resistance to Fingerprint | Resistance to Plasticizer |
| Example A1 | 37° | 57° | o | o |
| Example A2 | 29° | 103° | o | o |
| Example A3 | 32° | 106° | o | o |
| Example A4 | 18° | 103° | o | o |
| Example A5 | 12° | 101° | o | o |
| Example A6 | 29° | 100° | o | o |
| Example A7 | 20° | 102° | o | Δ |
| Example A8 | 48° | 96° | o | o |
| Example A9 | 63° | 98° | o | o |
| Example A10 | 60° | 79° | o | o |
| Example A11 | 49° | 86° | o | o |
| Comp. Ex. A1 | 4° | 75° | X | Δ |
| Comp. Ex. A2 | 5° | 92° | X | X |
| Comp. Ex. A3 | 4° | 78° | X | X |
| Comp. Ex. A4 | 3° | 57° | X | X |
| Comp. Ex. A5 | 9° | 80° | X | X |
| Comp. Ex. A6 | 5° | 97° | X | X |
| Comp. Ex. A7 | 8° | 92° | X | X |
| Comp. Ex. A8 | 7° | 92° | X | X |

Contact Angle: Water repellence of an image-recorded surface was evaluated by the contact angle between water and the image-recorded surface, while oil repellence was evaluated by the angle of contact between tetradecane and the image-recorded surface. Since tetradecane is stable at temperatures of approximately 20° C. (the boiling point and the melting point of tetradecane do not lie in the vicinity of 20° C.), it was employed for the measurement. Cyclodecane or the like is also employable for this purpose. The contact angles were measured by means of a liquid-droplet method using a "FACE Contactangle Meter CA-D Type" manufactured by Kyowa Kaimenkagaku K.K., Japan.

Resistance to fingerprints: Facial sebum was applied to a finger, and an image-recorded surface of an image-receiving sheet was pressed by the finger. Thereafter, the image-receiving sheet was preserved at a temperature of 50° C. for 16 hours. The image-recorded surface was visually observed, and rated against the following standard:

○: Not stained with a fingerprint

Δ: Slightly stained with a fingerprint

X: Stained with a fingerprint

Resistance to Plasticizers: Vaseline containing 10% of dioctylphthalate was applied to an image-recorded surface of an image-receiving sheet. Thereafter, the image-receiving sheet-was preserved at a temperature of 40° C. for 48 hours. The image-recorded surface was visually observed, and rated rated against the following standard:

○: No change is observed

Δ: Slightly faded in color

X: Remarkably faded in color

EXAMPLE A12

A coating solution having the following formulation was coated onto a substrate sheet, synthetic paper "Yupo FRG-150" (Trademark) with a thickness of 150 μm manufactured by Oji-Yuka Synthetic Paper Co., Ltd., by a bar coater in an amount of 5.0 g/m$^2$ on dry basis, and then dried to form a dye-receiving layer. A thermal transfer image-receiving sheet according to the present invention was thus obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Fluororesin ("Lumifron LF-2000" (Trademark) manufactured by Asahi Glass Co., Ltd.) | 10 parts |
| Isocyanate ("Coronate HK" (Trademark) manufactured by Nippon Polyurethane Industry Co., Ltd.) | 0.9 parts |
| Dibutyltin dilaurate | $3.5 \times 10^{-2}$ parts |
| Platinum catalytic hardener ("Cat PL50T" (Trademark) manufactured by Shin-Etsu Chemical Co., Ltd.) | 2 parts |
| Methyl ethyl ketone/Toluene (weight ratio = 1:1) | 600 parts |

EXAMPLE A13

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1"(Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 1 part |

-continued

| Formulation of Coating Solution: | |
|---|---|
| Fluororesin ("Lumifron LF-2000" (Trademark) manufactured by Asahi Glass Co., Ltd.) | 10 parts |
| Methyl ethyl ketone/Toluene (weight ratio = 1:1) | 600 parts |

EXAMPLE A14

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 1 part |
| Fluoroacrylic resin ("Modayper F-200" (Trademark) manufactured by Nippon Oils & Fats Co., Ltd.) | 20 parts |
| Methyl ethyl ketone/Toluene (weight ratio = 1:1) | 600 parts |

EXAMPLE A15

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 2 parts |
| Fluoroacrylic resin ("Modayper F-200" (Trademark) manufactured by Nippon Oils & Fats Co., Ltd.) | 20 parts |
| Isocyanate ("Coronate HK" (Trademark) manufactured by Nippon Polyurethane Industry Co., Ltd.) | 0.9 parts |
| Dibutyltin dilaurate | $3.5 \times 10^{-2}$ parts |
| Methyl ethyl ketone/Toluene (weight ratio = 1:1) | 600 parts |

EXAMPLE A16

The procedure of Example A14 was repeated except that the fluoroacrylic resin "Modayper F200" used in Example A14 was replaced by "Modayper FS710" (Trademark) manufactured by Nippon Oils and Fats Co., Ltd., whereby a thermal transfer image-receiving sheet according to the present invention was obtained.

EXAMPLE A17

The procedure of Example A15 was repeated except that the fluoroacrylic resin "Modayper F200" used in Example A15 was replaced by "Modayper FS710" (Trademark) manufactured by Nippon Oils and Fats Co., Ltd., whereby a thermal transfer image-receiving sheet according to the present invention was obtained.

EXAMPLE A18

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 1 part |
| Fluoroalcohol ("Unisafe HFA-5635" (Trademark) manufactured by Nippon Oils & Fats Co., Ltd.) | 5 parts |
| Alcohol-modified dimethylsiloxane (BY-16-005" (Trademark) manufactured by Toshiba Silicone Co., Ltd.) | 4 parts |
| Isocyanate ("Coronate HK" (Trademark) manufactured by Nippon Polyurethane Industry Co., Ltd.) | 10 parts |
| Dibutyltin dilaurate | $5 \times 10^{-3}$ parts |
| Methyl ethyl ketone/Toluene (weight ratio = 1:1) | 600 parts |

EXAMPLE A19

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Methylhydrogen polysiloxane ("BY-16-805" (Trademark) manufactured by Toray Silicone Co., Ltd.) | 10 parts |
| Silicone-hardening catalyst ("Cat PL50T" (Trademark) manufactured by Shin-Etsu Chemical Co., Ltd.) | 1 part |
| Allylhexafluoroisopropyl ether | 5 parts |
| Methyl ethyl ketone/Toluene (weight ratio = 1:1) | 600 parts |

EXAMPLE A20

The procedure of Example A19 was repeated except that the allylhexafluoroisopropyl ether used in Example A19 was replaced by an allylpentadecanefluorooctyl either, whereby a thermal transfer image-receiving sheet according to the present invention was obtained.

EXAMPLE A21

The procedure of Example A19 was repeated except that the allylhexafluoroisopropyl ether used in Example A19 was replaced by a fluoroalkylacrylate, "FA-1" (Trademark) manufactured by Kyoeisha Chemical Co., Ltd., whereby a thermal transfer image-receiving sheet according to the present invention was obtained.

EXAMPLE A22

A coating solution having the following formulation was coated onto the same substrate film as was used in Example 12 by a bar coater in an amount of 5.0 g/m$^2$ on dry basis, and then dried to form a dye-receiving layer. This was exposed to an UV light with an energy of 20 mJ/m$^2$ three times to harden the layer, whereby a thermal transfer image-receiving sheet according to the present invention was thus obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 1 part |
| 1,6-Hexanedioldiacrylate | 20 parts |
| Fluoroalkylacrylate ("FA-108" (Trademark) manufactured by Kyoeisha Chemical Co., Ltd.) | 10 parts |
| Photo-setting initiator ("Irgacure 183" (Trademark) manufactured by Ciba-Geigy, Ltd.) | 8 parts |
| Methyl ethyl ketone/Toluene (weight ratio = 1:1) | 600 parts |

EXAMPLE A23

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl acetoacetal ("S-Lec KS-1" (Trademark) manufactured by Sekisui Chemical Co., Ltd.) | 100 parts |
| Catalytically-hardening-type silicone ("X-62-1212" (Trademark) manufactured by Shin-Etsu Chemical Co., Ltd.) | 20 parts |
| Platinum catalytic hardener ("Cat PL50T" (Trademark) manufactured by Shin-Etsu Chemical Co., Ltd.) | 1 part |
| Fluoroalkyl silane ("XC95-470" (Trademark) manufactured by | 4 parts |

-continued

| Formulation of Coating Solution: | |
|---|---|
| Toshiba Silicone Co., Ltd.) | |
| Silanol-modified dimethylpolysiloxane ("YF-3057" (Trademark) manufactured by Toshiba Silicone Co., Ltd.) | 12 parts |
| Methyl ethyl ketone/Toluene (weight ratio = 1:1) | 600 parts |

EXAMPLE A24

The procedure of Example A23 was repeated except that the fluoroalkyl silane "XC95-470" used in Example A23 was replaced by "XC95-471" (Trademark) manufactured by Toshiba Silicone Co., Ltd., whereby a thermal transfer image-receiving sheet according to the present invention was obtained.

EXAMPLE A25

A coating solution having the same formulation as in Example A23, provided that the fluoroalkyl silane was eliminated therefrom, was prepared. The coating solution was coated onto a substrate film in the same manner as in Example A23, and dried. Thereafter, a methanol solution of a fluoroalkyl silane "XC-95-470" (Trademark) manufactured by Toshiba Silicone Co., Ltd. was coated onto the above-obtained layer, dried, and then cured at a temperature of 120° C. for 15 minutes, whereby a thermal transfer image-receiving sheet according to the present invention was obtained.

EXAMPLE A26

The procedure of Example A23 was repeated except that the fluoroalkyl silane "XC95-470" used in Example A23 was replaced by "XC95-471" (Trademark) manufactured by Toshiba Silicone Co., Ltd., whereby a thermal transfer image-receiving sheet according to the present invention was obtained.

EXAMPLE A27

The procedure of Example A12 was repeated except that the coating solution used in Example A12 was replaced by a coating solution having the following formulation, whereby a thermal transfer image-receiving sheet according to the present invention was obtained.

| Formulation of Coating Solution: | |
|---|---|
| Polyvinyl resin ("Vylon 200" (Trademark) manufactured by Toyobo Co., Ltd.) | 100 parts |
| Releasing-ability-impating silicone ("X-62-1212" (Trademark) manufactured by Shin-Etsu Chemical Co., Ltd.) | 10 parts |
| Silicone-hardening catalyst ("Cat PL50T" (Trademark) manufactured by Shin-Etsu Chemical Co., Ltd.) | 0.5 parts |
| Methyl ethyl ketone/Toluene (weight ratio = 1:1) | 600 parts |

EXAMPLES A28 TO A41

The procedure of Examples A13 to A26 were repeated except that the polyvinyl acetoacetal resin used in Examples A13 to A26 was replaced by polyester resin "Vylon 200" (Trademark) manufactured by Toyobo Co., Ltd., whereby thermal transfer image-receiving sheets according to the present invention were respectively prepared.

On the other hand, a thermal transfer recording sheet was prepared in the following manner:

A coating solution for forming a dye layer, having the following formulation was prepared. The coating solution was applied by a wire bar to a polyethylene terephthalate film having a thickness of 4.5 μm with its back surface imparted with heat resistance, and dried. The amount of the coating solution applied was 1.0 g/m$^2$ on dry basis. Several drops of silicone oil, "X-41.4003A" (Trademark) manufactured by Shin-Etsu Chemical Co., Ltd., were deposited on the back surface of the polyethylene terephthalate film using a dropping pipette, and then spread over the entire surface thereof. A back-coated thermal transfer recording sheet was thus obtained.

| Formulation of Coating Solution: | |
|---|---|
| Disperse dye ("Kayaset Blue 714" (Trademark) manufactured by Nippon Kayaku Co., Ltd.) | 7 parts |
| Polyvinyl butyral resin ("S-Lec BX-1" (Trademark) manufactured by Sekisui Chemical Co., Ltd.) | 4.5 parts |
| Methyl ethyl ketone/toluene (weight ratio = 1:1) | 90 parts |

The thermal transfer image-receiving sheets prepared in Examples A12 to A41 were evaluated in accordance with the following manner:

Each thermal transfer image-receiving sheet was superposed on the above-prepared thermal transfer recording sheet so that the dye-receiving layer of the image-receiving sheet faced the dye layer of the recording sheet. Thermal energy was then applied to the back surface of the heat transfer recording sheet by a thermal head to produce a cyan image under the following conditions:

| | |
|---|---|
| Output power: | 1 W/dot |
| Pulse width: | 0.3 to 0.45 msec |
| Dot density: | 6 dots/mm |

The image-recorded surface was evaluated in terms of the contact angles and resistance to oils, specifically, resistance to fingerprints and resistance to plasticizers. The results are shown in Table A3.

TABLE A3

| | Contact Angle | | Resistance to Oils | |
|---|---|---|---|---|
| | to Tetradecane | to Water | Resistance to Fingerprint | Resistance to Plasticizer |
| Example A12 | 19° | 99° | ○ | Δ |
| Example A13 | 16° | 98° | ○ | Δ |
| Example A14 | 70° | 108° | ○ | ○ |
| Example A15 | 69° | 107° | ○ | ○ |
| Example A16 | 25° | 104° | ○ | ○ |
| Example A17 | 26° | 103° | ○ | ○ |
| Example A18 | 34° | 102° | ○ | ○ |
| Example A19 | 40° | 105° | ○ | Δ |

TABLE A3-continued

| | Contact Angle | | Resistance to Oils | |
|---|---|---|---|---|
| | to Tetradecane | to Water | Resistance to Fingerprint | Resistance to Plasticizer |
| Example A20 | 45° | 108° | ○ | Δ |
| Example A21 | 43° | 103° | ○ | Δ |
| Example A22 | 60° | 109° | ○ | ○ |
| Example A23 | 53° | 103° | ○ | Δ |
| Example A24 | 62° | 102° | ○ | Δ |
| Example A25 | 59° | 109° | ○ | ○ |
| Example A26 | 65° | 110° | ○ | ○ |
| Example A27 | 13° | 90° | ○ | Δ |
| Example A28 | 17° | 95° | ○ | Δ |
| Example A29 | 63° | 105° | ○ | ○ |
| Example A30 | 64° | 104° | ○ | ○ |
| Example A31 | 22° | 100° | ○ | ○ |
| Example A32 | 24° | 101° | ○ | ○ |
| Example A33 | 30° | 103° | ○ | ○ |
| Example A34 | 39° | 103° | ○ | Δ |
| Example A35 | 42° | 105° | ○ | ○ |
| Example A36 | 40° | 103° | ○ | Δ |
| Example A37 | 63° | 108° | ○ | ○ |
| Example A38 | 50° | 100° | ○ | Δ |
| Example A39 | 52° | 102° | ○ | Δ |
| Example A40 | 57° | 105° | ○ | ○ |
| Example A41 | 55° | 103° | ○ | ○ |

Contact Angle: W Water repellence of an image-recorded surface was evaluated by the angle of contact between water and the image-recorded surface, while oil repellence was evaluated by the angle of contact between tetradecane and the image-recorded surface. Since tetradecane is stable at temperatures of approximately 20° C. (the boiling point and the melting point of tetradecane do not lie in the vicinity of 20° C.), it was employed for the measurement. Cyclodecane or the like is also employable for this purpose. The angles of contact were measured by means of a liquid droplet method using a "FACE Contactangle Meter CA-D Type" manufactured by Kyowa Kaimenkagaku Kabushiki Kaisha.

Resistance to Fingerprints: Facial sebum was applied to a finger, and an image-recorded surface of an image-receiving sheet was pressed by the finger. Thereafter, the image-receiving sheet was preserved at a temperature of 50° C. for 16 hours. The image-recorded surface was visually observed, and rated against the following standard:

○: Not stained with a fingerprint

Δ: Slightly stained with a fingerprint

X: Stained with a fingerprint

Resistance to Plasticizers: Vaseline containing 10% of dioctylphthalate was applied to an image-recorded surface of an image-receiving sheet. Thereafter, the image-receiving sheet was preserved at a temperature of 40° C. for 48 hours. The image-recorded surface was visually observed, and rated rated against the following standard:

○: No change is observed

Δ: Slightly faded in color

X: Remarkably faded in color

As is clearly understood from the results obtained in the above Examples and Comparative Examples, a thermal transfer image-receiving sheet can produce an image which has excellent resistance to oils, specifically, resistance to fingerprints and resistance to plasticizers, when a dye-receiving layer of the image-receiving sheet is formed to have a contract angle to tetradecane of 10° or greater.

EXAMPLES B1 TO B7 AND COMPARATIVE EXAMPLE B1

A coating solution having a dye layer, having the following formulation was applied by a wire bar to a polyethylene terephthalate film having thickness of 4.5 μm with its back surface imparted with heat resistance, and dried. The amount of the coating solution applied was 1.0 g/m$^2$ on dry basis. Several drops of silicone oil, "X-41.4003A" (Trademark) manufactured by Shin-Etsu Chemical Co., Ltd., were deposited on the back surface of the polyethylene terephthalate film by a dropping pipette, and spread over the entire surface thereof. A back-coated thermal transfer recording sheet was thus obtained.

| Formulation of Coating Solution: | |
|---|---|
| Disperse dye, C.I. Solvent Blue 63 ("Kayaset Blue 714" (Trademark) manufactured by Nippon Kayaku Co., Ltd.) | 7 parts |
| Polyvinyl butyral resin ("S-Lec BX-l" (Trademark) manufactured by Sekisui Chemical Co., Ltd.) | 4.5 parts |
| Fluorine-containing surface active agent ("Fluorald FC-430" (Trademark) manufactured by Sumitomo 3M limited) (see Table B1) | X parts |
| Methyl ethyl ketone/Toluene (weight ratio = 1:1) | 90 parts |

TABLE B1

| Example | X |
|---|---|
| Example B1 | 0.1 |
| Example B2 | 0.3 |
| Example B3 | 0.5 |
| Example B4 | 1.0 |
| Example B5 | 2.0 |
| Example B6 | 5.0 |
| Example B7 | 10.0 |
| Comparative Example B1 | 0.0 |

On the other hand, a coating solution for forming a dye-receiving layer, having the following formulation was coated onto one surface of a substrate sheet, synthetic paper "Yupo FRG-150" (Trademark) with a thickness of 150 μm manufactured by Oji-Yuka Synthetic Paper Co., Ltd., by a bar coater in an amount of 5.0 g/m$^2$ on dry basis, and roughly dried by a dryer immediately. This was further dried in an oven at a temperature of 80° C. for 5 minutes, thereby obtaining a thermal transfer image-receiving sheet.

| Formulation of Coating Solution: | |
|---|---|
| Polyester ("Vylon 200" (Trademark) manufactured by Toyobo Co., Ltd.) | 20 parts |
| Amino-modified silicone ("X-22-3050C" (Trademark) manufactured by Shin-Etsu Chemical Co., Ltd.) | 2 parts |
| Epoxy-modified silicone ("X-22-3000E" (Trademark) manufactured by Shin-Etsu Chemical Co., Ltd.) | 2 parts |
| Methyl ethyl ketone/Toluene (weight ratio = 1:1) | 80 parts |

The thermal transfer recording sheets prepared in Examples B1 to B7 and Comparative Examples B1 were evaluated in accordance with the following manner:

Each thermal transfer recording sheet was superposed on the above-prepared thermal transfer image-receiving sheet so that the dye layer of the recording sheet faced the dye-receiving layer of the image-receiving sheet. Thermal energy was then applied to the back surface of the heat transfer recording sheet by a thermal head to produce a cyan image under the following conditions:

| | |
|---|---|
| Output power: | 1 W/dot |
| Pulse width: | 0.3 to 0.45 msec |
| Dot density: | 6 dots/mm |

The image-recorded surface was evaluated in terms of the contact angles and resistance to oils, specifically, resistance to fingerprints and resistance to plasticizers. The results are shown in Table B2.

TABLE B2

| | Contact Angle | | Resistance to Oils | |
|---|---|---|---|---|
| | to Tetradecane | to Water | Resistance to Fingerprint | Resistance to Plasticizer |
| Example B1 | 29° | 92° | o | Δ |
| Example B2 | 32° | 94° | o | Δ |
| Example B3 | 32° | 94° | o | o |
| Example B4 | 40° | 93° | o | o |
| Example B5 | 47° | 96° | o | o |
| Example B6 | 50° | 92° | o | o |
| Example B7 | 60° | 90° | o | o |
| Comp. Ex. B1 | 5° | 95° | X | X |

EXAMPLES B1 TO B7 AND COMPARATIVE EXAMPLE B1

Ink compositions for forming a dye layer composed of three color layers were respectively prepard in accordance with the following formulations.

| | |
|---|---|
| Yellow: | |
| Disperse dye, C.I. Disperse Yellow 201 ("Macrolex Yellow 6G" (Trademark) manufactured by Bayer AG) | 5.5 parts |
| Polyvinyl butyral resin ("S-Lec BX-1" (Trademark) manufactured by Sekisui Chemical Co., Ltd.) | 4.5 parts |
| Methyl ethyl ketone/Toluene (weight ratio = 1:1) | 90.0 parts |
| Magenta: | |
| Disperse dye, C.I. Disperse Violet 26 ("Macrolex Red Violet R" (Trademark) manufactured by Bayer AG) | 5.5 parts |
| Polyvinyl butyral resin ("S-Lec BX-1" (Trademark) manufactured by Sekisui Chemical Co., Ltd.) | 4.5 parts |
| Methyl ethyl ketone/Toluene (weight ratio = 1:1) | 90.0 parts |
| Cyan: | |
| Disperse dye ("Foron Brilliant Blue S-R" (Trademark) manufactured by Sandoz K.K.) | 3.0 parts |
| Polyvinyl butyral resin ("S-Lec BX-1" (Trademark) manufactured by Sekisui Chemical Co., Ltd.) | 5.0 parts |
| Methyl ethyl ketone/Toluene | 92.0 parts |

-continued

| |
|---|
| (weight ratio = 1:1) |

The above-prepared ink compositions were respectively applied to a polyethylene terephthalate film having a thickness of 4.5 μm, "Lumiror 5AF53" (Trademark) manufactured by Toray Industries, Inc., with its back surface imparted with heat resistance by a wire bar consecutively. The application amount of each ink composition was 1.0 g/m$^2$ on dry basis, and the width of each color layer was made 30 cm. Right after the application, the ink compositions were roughly dried by a dryer, and then dried in an oven at a temperature of 80° C. for 5 minutes to form a dye layer composed of three color layers.

Subsequently, a 10% solution of a fluororesin "Fluorald S-132" (Trademark) manufactured by Asahi Glass Co., Ltd. was coated onto the surface of the dye layer in accordance with the conditions shown in Table B3, thereby obtaining a thermal transfer recording sheet having a dye layer composed of three color layers. A full-colored image was produced using the above-obtained thermal transfer recording sheet in the same manner as in Example B1. The image-recorded surface was evaluated in terms of the contact angles and resistance to oils, specifically, resistance to fingerprints and resistance to plasticizers. The results are shown in Table B3.

TABLE B3

| | Fluoro-resin-coated-color layer | Coating Amount (g/m$^2$) | Contact Angle to Water | Contact Angle to Tetra-decane | Resistance to Oils: Resis-tance to Finger-print | Resistance to Oils: Resis-tance to Plasti-cizer |
|---|---|---|---|---|---|---|
| Example B8 | Y | 0.8 | 30° | 101° | o | o |
| Example B9 | Y | 0.4 | 29° | 99° | o | o |
| Example B10 | Y | 0.6 | 32° | 96° | o | o |
| Example B11 | C | 0.6 | 40° | 98° | o | o |
| Example B12 | Y M | 0.4 | 40° | 99° | o | o |
| Example B13 | Y C | 0.5 | 42° | 98° | o | o |
| Example B14 | M C | 0.6 | 44° | 97° | o | o |
| Example B15 | YMC | 0.1 | 48° | 95° | o | o |
| Comparative Example B2 | | 0 | 5° | 101° | X | X |

(Note)
Y: Yellow color layer
M: Magenta color layer
C: Cyan color layer

EXAMPLES B16 TO B20

A dye layer composed of three color layers was formed on a substrate film in the same manner as in Example B8. A coating solution having the following formulation was then coated onto the substrate film, adjacent to the color layer in accordance with the conditions shown in Table B4, and dried to form an oil-repelling agent layer, whereby a thermal transfer recording sheet according to the present invention was obtained.

A full-colored image was produced using the above thermal transfer recording sheet in the same manner as in Example B1. The image-recorded surface was evaluated in terms of the angles of contact and resistance to oils, specifically, resistance to fingerprints and resistance to plasticizers. The results are shown in Table B4.

| Coating Solution for forming Oil-Repelling Agent Layer: | |
|---|---|
| Polyvinyl butyral resin ("S-Lec BX-1" (Trademark) manufactured by Sekisui Chemical Co., Ltd.) | 4.5 parts |
| Fluororesin ("Fluorald SC-101" (Trademark) manufactured by Asahi Glass Co., Ltd.) | (see Table B4) |
| Methyl ethyl ketone/Toluene (weight ratio = 1:1) | 95 parts |

TABLE B4

| | Position of Oil-Repelling Agent Layer | Coating Amount (g/m$^2$) | Contact Angle to Water | Contact Angle to Tetra-decane | Resistance to Oils: Resis-tance to Finger-print | Resistance to Oils: Resis-tance to Plasti-cizer |
|---|---|---|---|---|---|---|
| Example B16 | before Y | 5 | 25° | 96° | o | o |
| Example B17 | after Y | 5 | 32° | 94° | o | o |
| Example B18 | after M | 5 | 40° | 99° | o | o |
| Example B19 | after C | 5 | 45° | 98° | o | o |
| Example B20 | after C | 1 | 52° | 97° | o | o |
| Comparative Example B3 | none | 0 | 6° | 102° | X | X |

EXAMPLES B21 TO B25

The procedures of Examples B8 to B15 were respectively repeated except that the fluororesin "Fluorald SC-101, employed in Examples B8 to B15 was replaced by "Fluorald S-111" (Trademark) manufactured by Asahi Glass Co., Ltd., whereby thermal transfer recording sheets according to the present invention were obtained.

The thermal transfer recording sheets thus obtained were evaluated in the same manner as in Examples B8 to B15. The results are shown in Table B5.

TABLE B5

| | Coating Amount (g/m$^2$) | Contact Angle to Water | Contact Angle to Tetra-decane | Resistance to Oils: Resistance to Fingerprint | Resistance to Oils: Resistance to Plasticizer |
|---|---|---|---|---|---|
| Example | 0.01 | 25° | 96° | o | o |

TABLE B5-continued

| | Coating Amount ($g/m^2$) | Contact Angle to Water | Contact Angle to Tetra-decane | Resistance to Oils: Resistance to Fingerprint | Resistance to Oils: Resistance to Plasticizer |
|---|---|---|---|---|---|
| B21 Example | 0.1 | 32° | 94° | ○ | ○ |
| B22 Example | 0.3 | 40° | 93° | ○ | ○ |
| B23 Example | 0.5 | 45° | 93° | ○ | ○ |
| B24 Example | 0.8 | 52° | 92° | ○ | ○ |
| B25 | | | | | |

Contact Angle: Water repellence of an image-recorded surface was evaluated by the contact angle between water and the image-recorded surface, while oil repellence was evaluated by the contact angle between tetradecane and the image-recorded surface. Since tetradecane is stable at temperatures of approximately 20° C. (the boiling point and the melting point of tetradecane do not lie in the vicinity of 20° C.), it was employed for the measurement. Cyclodecane or the like is also employable for this purpose. The contact angles were measured by means of a liquid-droplet method using a "FACE Contactangle Meter CA-D Type" manufactured by Kyowa Kaimenkagaku Kabushiki Kaisha.

Resistance to fingerprints: Facial sebum was applied to a finger, and an image-recorded surface of an image-receiving sheet was pressed by the finger. Thereafter, the image-receiving sheet was preserved at a temperature of 50° C. for 16 hours. The image-recorded surface was visually observed, and rated against the following standard:

○: Not stained with a fingerprint

Δ: Slightly stained with a fingerprint

X: Stained with a fingerprint

Resistance to Plasticizers: Vaseline containing 10% of dioctylphthalate was applied to an image-recorded surface of an image-receiving sheet. Thereafter, the image-receiving sheet was preserved at a temperature of 40° C. for 48 hours. The image-recorded surface was visually observed, and was rated against the following standard:

○: No change is observed

Δ: Slightly faded in color

X: Remarkably faded in color

As is clearly understood from the results obtained in the above Examples and Comparative Examples, when an oil-repelling agent is supplied to a dye-receiving layer of a a thermal transfer image-receiving sheet from a thermal transfer recording sheet when or after an image is produced in the dye-receiving layer, the image has excellent resistance to oil, specifically, resistance to fingerprints and resistance to plasticizers.

Further, when the image-recorded surface has a contact angle to tetradecane of 10° or greater, the image has excellent resistance to oils, specifically, resistance to fingerprints and resistance to plasticizers.

EXAMPLES C1 TO C7 AND COMPARATIVE EXAMPLE C1

A coating solution for forming a dye layer, having the following formulation was applied by a wire bar to a polyethylene terephthalate film having a thickness of 4.5 μm with its back surface imparted with heat resistance, and dried. The amount of the coating solution applied was 1.0 $g/m^2$ on dry basis. Several drops of silicone oil, "X-41.4003A" (Trademark) manufactured by Shin-Etsu Silicone Co., Ltd., were deposited on the back surface of the polyethylene terephthalate film by a dropping pipette, and then spread over the entire surface thereof. A back-coated thermal transfer recording sheet was thus obtained.

| Formulation of Coating Solution: | |
|---|---|
| Disperse dye, C.I. Solvent Blue 63 ("Kayaset Blue 714" (Trademark) manufactured by Nippon Kayaku Co., Ltd.) | 7 parts |
| Polyvinyl butyral resin ("S-Lec BX-1" (Trademark) manufactured by Sekisui Chemical Co., Ltd.) | 4.5 parts |
| Fluorine-containing surface active agent ("Fluorald FC-430" (Trademark) manufactured by Sumitomo 3M Limited) | X parts (see Table C1) |
| Methyl ethyl ketone/Toluene (weight ratio = 1:1) | 90 parts |

TABLE C1

| Example | X |
|---|---|
| Example C1 | 0.1 |
| Example C2 | 0.3 |
| Example C3 | 0.5 |
| Example C4 | 1.0 |
| Example C5 | 2.0 |
| Example C6 | 5.0 |
| Example C7 | 10.0 |
| Comparative Example C1 | 0.0 |

On the other hand, a coating solution for forming a dye-receiving layer, having the following formulation was coated onto one surface of a substrate sheet, synthetic paper "Yupo FRG-150" (Trademark) with a thickness of 150 μm manufactured by Oji-Yuka Synthetic Paper Co., Ltd., by a bar coater in an amount of 5.0 $g/m^2$ on dry basis, and then roughly dried by a dryer immediately. This was further dried in an oven at a temperature of 80° C. for 5 minutes, thereby obtaining a thermal transfer image-receiving sheet.

| Formulation of Coating Solution: | |
|---|---|
| Polyester ("Vylon 200" (Trademark) manufactured by Toyobo Co., Ltd.) | 20 parts |
| Amino-modified silicone ("X-22-3050C" (Trademark) manufactured by Shin-Etsu Chemical Co., Ltd.) | 2 parts |
| Epoxy-modified silicone ("X-22-3000E" (Trademark) manufactured by Shin-Etsu Chemical Co., Ltd.) | 2 parts |
| Methyl ethyl ketone/Toluene (weight ratio = 1:1) | 80 parts |

The thermal transfer recording sheets prepared in Examples C1 to C7 and Comparative Example C1 were evaluated in accordance with the following manner:

Each thermal transfer recording sheet was superposed on the above-prepared thermal transfer image-receiving sheet so that the dye layer of the recording sheet faced the dye-receiving layer of the image-receiving sheet. Thermal energy was then applied to the back surface of the heat transfer recording sheet by a thermal head to produce a cyan image under the following conditions:

| | |
|---|---|
| Output power: | 1 W/dot |
| Pulse width: | 0.3 to 0.45 msec |
| Dot density: | 6 dots/mm |

The image-recorded surface was evaluated in terms of the contact angles and resistance to oils, specifically, resistance to fingerprints and resistance to plasticizers. The results are shown in Table C2.

TABLE C2

| | Contact Angle | | Resistance to Oils | |
|---|---|---|---|---|
| | to Tetradecane | to Water | Resistance to Fingerprint | Resistance to Plasticizer |
| Example C1 | 29° | 92° | o | o |
| Example C2 | 32° | 94° | | |
| Example C3 | 32° | 94° | | |
| Example C4 | 40° | 93° | | |
| Example C5 | 47° | 96° | | |
| Example C6 | 50° | 92° | | |
| Example C7 | 60° | 90° | | |
| Comparative Example C1 | 5° | 95° | | |

EXAMPLES C8 TO C15 AND COMPARATIVE EXAMPLE C2

Ink compositions for forming a dye layer composed of three color layers were respectively prepared in accordance with the following formulations.

| | |
|---|---|
| Yellow: | |
| Disperse dye, C.I. Disperse Yellow 201 ("Macrolex Yellow 6G" (Trademark) manufactured by Bayer AG) | 5.5 parts |
| Polyvinyl butyral resin ("S-Lec BX-1" (Trademark) manufactured by Sekisui Chemical Co., Ltd.) | 4.5 parts |
| Methyl ethyl ketone/Toluene (weight ratio = 1:1) | 90.0 parts |
| Magenta: | |
| Disperse dye, C.I. Disperse Violet 26 ("Macrolex Red Violet R" (Trademark) manufactured by Bayer AG) | 5.5 parts |
| Polyvinyl butyral resin ("S-Lec BX-1" (Trademark) manufactured by Sekisui Chemical Co., Ltd.) | 5.5 parts |
| Methyl ethyl ketone/Toluene (weight ratio = 1:1) | 90.0 parts |
| Cyan: | |
| Disperse dye ("Foron Brilliant Blue S-R" (Trademark) manufactured by Sandoz K.K.) | 3.0 parts |
| Polyvinyl butyral resin ("S-Lec BX-1" (Trademark) manufactured by Sekisui Chemical Co., Ltd.) | 5.0 parts |
| Methyl ethyl ketone/Toluene (weight ratio = 1:1) | 92.0 parts |

The above-prepared ink compositions were respectively applied to a polyethylene terephthalate film having a thickness of 4.5 μm, "Lumiror 5AF53" (Trademark) manufactured by Toray Industries, Inc., with its back surface imparted with heat resistance by a wire bar consecutively. The application amount of each ink composition was 1.0 g/m$^2$ on dry basis, and the width of each color layer was made 30 cm. Right after the application, the ink compositions were roughly dried by a dryer, and then dried in an oven at a temperature of 80° C. for 5 minutes to form a dye layer composed of three color layers.

Subsequently, a 10% solution of a fluororesin "Fluorald S-132" (Trademark) manufactured by Asahi Glass Co., Ltd. was coated onto the surface of the dye layer in accordance with the conditions shown in Table B3. Thus, eight thermal transfer recording sheets were obtained. A full-colored image was produced using the above-obtained each thermal transfer recording sheet in the same manner as in Example C1. The image-recorded surface was evaluated in terms of the contact angles and resistance to oils, specifically, resistance to fingerprints and resistance to plasticizers. The results are shown in Table C3.

TABLE C3

| | Fluoro-resin-coated-color layer | Coating Amount (g/m$^2$) | Contact Angle | | Resistance to Oils | |
|---|---|---|---|---|---|---|
| | | | to Water | to Tetra-decane | Resis-tance to Finger-print | Resis-tance to Plasti-cizer |
| Example C8 | Y | 0.8 | 30° | 101° | o | o |
| Example C9 | Y | 0.4 | 29° | 99° | o | o |
| Example C10 | M | 0.6 | 32° | 96° | o | o |
| Example C11 | C | 0.6 | 40° | 98° | o | o |
| Example C12 | Y M | 0.4 | 40° | 99° | o | o |
| Example C13 | Y C | 0.5 | 42° | 98° | o | o |
| Example C14 | M C | 0.6 | 44° | 97° | o | o |
| Example C15 | YMC | 0.1 | 48° | 95° | o | o |
| Comparative Example C2 | | 0 | 5° | 101° | X | X |

EXAMPLES C16 TO C20

A dye layer composed of three color layers was formed on a substrate film in the same manner as in Example C8. A coating solution having the following formulation was then coated onto the substrate film, adjacent to the color layer in accordance with the conditions shown in Table C4, and dried to form an oil-repelling agent layer, whereby a thermal transfer recording sheet according to the present invention was obtained.

A full-colored image was produced using the above thermal transfer recording sheet in the same manner as in Example C1. The image-recorded surface was evaluated in terms of the contact angles and resistance to oils, specifically, resistance to fingerprints and resistance to plasticizers. The results are shown in Table C4.

| Coating Solution for Forming Oil-Repelling Agent Layer: | |
|---|---|
| Polyvinyl butyral resin ("S-Lec BX-1" (Trademark) manufactured by Sekisui Chemical Co., Ltd.) | 4.5 parts |
| Fluororesin ("Fluorald SC-101" (Trademark) manufactured by Asahi Glass Co., Ltd.) | (see Table C4) |
| Methyl ethyl ketone/Toluene (weight ratio = 1:1) | 95 parts |

TABLE C4

| | Position of Oil-Repelling Agent Layer | Coating Amount (g/m²) | Contact Angle to Water | Contact Angle to Tetra-decane | Resistance to Oils: Resistance to Finger-print | Resistance to Oils: Resistance to Plasti-cizer |
|---|---|---|---|---|---|---|
| Example C16 | before Y | 5 | 33° | 101° | ○ | ○ |
| Example C17 | after Y | 5 | 35° | 99° | ○ | ○ |
| Example C18 | after M | 5 | 36° | 99° | ○ | ○ |
| Example C19 | after C | 5 | 40° | 97° | ○ | ○ |
| Example C20 | after C | 1 | 38° | 99° | ○ | ○ |
| Comparative Example C3 | none | 0 | 6° | 102° | X | X |

EXAMPLES C21 TO C25

The procedures of Examples C8 to C15 were repeated except that the fluororesin "Fluorald SC-101" employed in Examples C8 to C15 was replaced by "Fluorald S-111" (Trademark) manufactured by Asahi Glass Co., Ltd., whereby thermal transfer recording sheets according to the present invention were respectively obtained.

The thermal transfer recording sheets thus obtained were evaluated in the same manner as in Examples C8 to C15. The results are shown in Table C5.

TABLE C5

| | Coating Amount (g/m²) | Contact Angle to Water | Contact Angle to Tetra-decane | Resistance to Oils: Resistance to Fingerprint | Resistance to Oils: Resistance to Plasticizer |
|---|---|---|---|---|---|
| Example C21 | 0.01 | 30° | 101° | ○ | ○ |
| Example C22 | 0.1 | 29° | 99° | ○ | ○ |
| Example C23 | 0.3 | 32° | 96° | ○ | ○ |
| Example C24 | 0.5 | 40° | 98° | ○ | ○ |
| Example C25 | 0.8 | 40° | 99° | ○ | ○ |

Contact Angle: Water repellence of an image-recorded surface was evaluated by the contact angle between water and the image-recorded surface, while oil repellence was evaluated by the contact angle between tetradecane and the image-recorded surface. Since tetradecane is stable at temperatures of approximately 20° C. (the boiling point and the melting point of tetradecane do not lie in the vicinity of 20° C.), it was employed for the measurement. Cyclodecane or the like is also employable for this purpose. The contact angles were measured by means of a liquid-droplet method using a "FACE Contactangle Meter CA-D Type" manufactured by Kyowa Kaimenkagaku Kabushiki Kaisha.

Resistance to fingerprints: Facial sebum was applied to a finger, and an image-recorded surface of an image-receiving sheet was pressed by the finger. Thereafter, the image-receiving sheet was preserved at a temperature of 50° C. for 48 hours. The image-recorded surface was visually observed, and rated against the following standard:

○: Not stained with a fingerprint

Δ: Slightly stained with a fingerprint

X: Stained with a fingerprint

Resistance to Plasticizer: Vaseline containing 10% of dioctylphthalate was applied to an image-recorded surface of an image-receiving sheet. Thereafter, the image-receiving sheet was preserved for 40 hours. The image-recorded surface was visually observed, and rated against the following standard:

○: No change is observed

Δ: Slightly faded in color

X: Remarkably faded in color

As is clearly understood from the results obtained in the above Examples and Comparative Examples, when an image-recorded surface of an image-receiving sheet has an angle of contact with tetradecane of 10° or greater, the image has excellent resistance to oils, specifically, resistance to fingerprints and resistance to plasticizers.

What is claimed is:

1. A thermal transfer image-receiving sheet having a thermal-transfer-recorded image formed thereon by sublimation thermal transfer recording, wherein said sheet comprises a substrate and a dye receiving resin, and the image-recorded surface of said sheet has a contact angle to tetradecane of 10° or greater.

* * * * *